US008006840B2

(12) United States Patent
Babcock et al.

(10) Patent No.: US 8,006,840 B2
(45) Date of Patent: Aug. 30, 2011

(54) ADAPTER FOR WIRE DISPENSING CARTON

(75) Inventors: Kenneth R. Babcock, Bellflower, CA (US); James H. Coffey, Ponte Vedra, FL (US)

(73) Assignee: Paige Electric Company, L.P., Union, NJ (US)

( * ) Notice: Subject to any disclaimer, the term of this patent is extended or adjusted under 35 U.S.C. 154(b) by 1064 days.

(21) Appl. No.: 11/375,727

(22) Filed: Mar. 15, 2006

(65) Prior Publication Data

US 2007/0075171 A1 Apr. 5, 2007

Related U.S. Application Data

(60) Provisional application No. 60/722,643, filed on Sep. 30, 2005.

(51) Int. Cl.
*B65D 85/00* (2006.01)

(52) U.S. Cl. ..... 206/395; 206/397; 206/408; 242/588

(58) Field of Classification Search ..... 242/588, 242/588.5, 588.6; 206/395, 397, 408, 409, 206/806, 389, 493, 526, 388; 211/44, 78, 211/164, 85.5; 248/200, 213.2, 300, 316.8, 248/905

See application file for complete search history.

(56) References Cited

U.S. PATENT DOCUMENTS

| | | | | |
|---|---|---|---|---|
| 851,367 | A | 4/1907 | Mossberg | |
| 922,695 | A * | 5/1909 | Haas | 206/408 |
| 2,890,821 | A | 6/1959 | Becker | |
| 3,178,092 | A | 4/1965 | Munana et al. | |
| 3,184,053 | A | 5/1965 | Eldridge | |
| 3,229,812 | A | 1/1966 | Metzger | |
| 3,982,712 | A * | 9/1976 | Bassett | 206/395 |
| 4,006,854 | A | 2/1977 | Gibson et al. | |
| 4,019,636 | A | 4/1977 | Wise | |
| 4,160,533 | A | 7/1979 | Kotzur et al. | |
| 4,179,030 | A | 12/1979 | Hayes et al. | |
| 4,306,687 | A | 12/1981 | Hadtke | |
| 4,373,687 | A * | 2/1983 | Zicko | 242/163 |
| 4,406,419 | A | 9/1983 | Kotzur | |
| D286,493 | S | 11/1986 | Floyd | |
| 4,817,796 | A | 4/1989 | Camillo et al. | |
| 4,830,305 | A * | 5/1989 | Guggi et al. | 242/588.5 |
| 4,956,908 | A * | 9/1990 | Morse et al. | 206/409 |
| 5,246,111 | A | 9/1993 | Shibazaki | |
| 5,447,237 | A * | 9/1995 | Carter et al. | 206/806 |
| 5,529,186 | A | 6/1996 | Bass | |
| 5,642,812 | A | 7/1997 | Hale | |
| 5,704,479 | A | 1/1998 | Barnett et al. | |
| 5,979,812 | A | 11/1999 | Kotzur et al. | |
| 6,059,220 | A | 5/2000 | Lassiter | |
| 6,341,691 | B1 | 1/2002 | Voss | |
| 6,766,627 | B2 | 7/2004 | Kotzur et al. | |
| 6,935,040 | B2 | 8/2005 | Alrutz et al. | |
| 7,007,799 | B2 * | 3/2006 | Cote | 206/409 |
| 7,168,654 | B2 * | 1/2007 | Silverbrook et al. | 242/588.6 |
| 7,204,452 | B2 * | 4/2007 | Wilkinson et al. | 242/614 |
| 7,347,395 | B2 * | 3/2008 | Horn | 242/598.5 |

* cited by examiner

*Primary Examiner* — William A Rivera
(74) *Attorney, Agent, or Firm* — Cook Alex Ltd.

(57) ABSTRACT

An adapter for inserting into a carton containing a non-reel coil of filamentary material or wire has a shaft-receiving sleeve supported by a box structure. The adapter's box structure has top and back walls joined at right angles and reinforced by side walls. Knobs extend outwardly from the side walls and have openings therethrough. Ribs on the underside of the top wall define a channel which is aligned with the openings in the knobs. The ribs, top wall and knobs define a sleeve which is oriented such that it may receive a shaft or rod of a wire pulling rack. Alternatively, said adapter having a box structure with walls only in two perpendicular planes. At least two of said walls forming a channel extending outwardly that may receive a shaft or rod.

10 Claims, 5 Drawing Sheets

36
49
40
38
50
42
48
34
31
32
46
44
55
56
54
52

ADAPTER FOR WIRE DISPENSING CARTON

This application claims the benefit of U.S. Provisional Application Serial No. 60/722,643, filed Sep. 30,2005.

BACKGROUND OF THE INVENTION

Filamentary materials such as wires, cables and the like are typically available to electricians or technicians in two forms, on reels or within non-reel cartons. The use of reels for the storage, transportation and dispensing of wire or cable is well known in the art. Presently, when electricians wish to dispense wire via a reel, they might attach the reel to a horizontal shaft of a pulling rack. For example, see Floyd U.S. Pat. No. D286,493. An electrician would then be able to pull the wire or cable tangentially off the reel.

However, as an electrician pulls the wire, the entire reel rotates and develops momentum. As a result, when the electrician stops pulling, the reel will continue to spin and release wire. The extra wire will often tangle or kink, requiring the electrician to untangle the wire and recoil the excess back on to the reel. Another problem with reel packages is disposal of the empty reel after all the wire has been removed.

Non-reel cartons eliminate the need for a reel and the attendant problem of recoiling. These cartons are sometimes also referred to as speed out cartons. Non-reel cartons utilize either conventional cardboard cartons or specialized cartons with dispensing guides. A single strand, or a multiconductor cable, of material is coiled with an open center ("air core") and then placed into the carton. The strand is then dispensed through an opening in a wall of the carton. The coil is unwound from the center or innermost strand without rotating the entire coil. See Wise U.S. Pat. No. 4,019,636. While non-reel cartons eliminate the unraveling and recoiling problems associated with reels, these cartons have their own problems. For example, when a coil is unwound from the center of a carton placed on the floor, there can develop enough resistance to uncoiling that the entire carton may tend to slide in the direction of dispensing. This is especially true when the wire is required to make sharp bends as it feeds through a payout tube in the side of the carton. Any tangling of the wire within the carton exacerbates this problem.

Another problem with non-reel cartons has more to do with common industry practice than with the carton itself. Many electricians prefer to use a portable wire pulling rack on which they can mount several different sizes, types and colors of wire. This provides ready access to whatever type of wire is needed for a particular job. The pulling racks typically have one or more shafts on which are mounted reel type wire packages. Non-reel cartons have no structure that enables them to be mounted on such a rack. If a hole is punched in the non-reel carton to admit the shaft, there is a risk that doing so will damage the contents of the carton. Further, even if a shaft hole is successfully formed in the carton, the carton is not strong enough to support the weight of a full coil of wire on a shaft. Pulling forces would further degrade such a jury-rigged carton.

Another problem with existing non-reel cartons is the tendency of the cartons to tear at hand-hole openings. Such openings are provided to make it easy to grasp the carton and carry it. Often users will attempt to use one hand only to lift and carry the carton by the hand-hole opening. Depending on the contents of the carton, this can cause the carton to fail in the area surrounding the opening. The hand-hole then becomes useless and the carton must thereafter be lifted from the bottom, usually using two hands. Hand-hole failure can be a particular problem if the carton has been allowed to become damp or wet. Accordingly, this invention seeks to overcome these short comings by providing an adapter for non-reel cartons that allows such cartons to be used on a wire pulling rack.

SUMMARY OF THE INVENTION

The adapter of the present invention is constructed such that it allows a non-reel carton or container to be hung from a bar, rod or shaft of a wire pulling rack with only minor modifications to the carton. The adapter has a box structure formed by walls or plates that are engageable with at least a single surface of the carton. The box structure has walls in two or three perpendicular planes and is adapted for placement against the interior top surface of the carton or in a corner of the carton. The box structure mounts a shaft-receiving sleeve or channel. The sleeve or channel defines a passage through which a shaft may be placed. The sleeve or channel transfers gravity and pulling loads to the box structure which in turn spreads these loads over a large enough surface of the carton that the carton will not be damaged by mounting it on a wire pulling rack.

The adapter may take the form of a variety of shapes or structures. It may be manufactured from different materials, including, for example, metal, plastic or fiberglass. The adapter may also contain one or more apertures or openings, for example, to decrease the amount of material used in construction of the adapter, to increase the strength of the adapter, or to provide handholds for the combination of the adapter and carton. The configuration of the walls allows the adapter to be placed into a carton containing a non-reel coil of filamentary material.

DETAILED DESCRIPTION OF THE INVENTION

Figure 2:
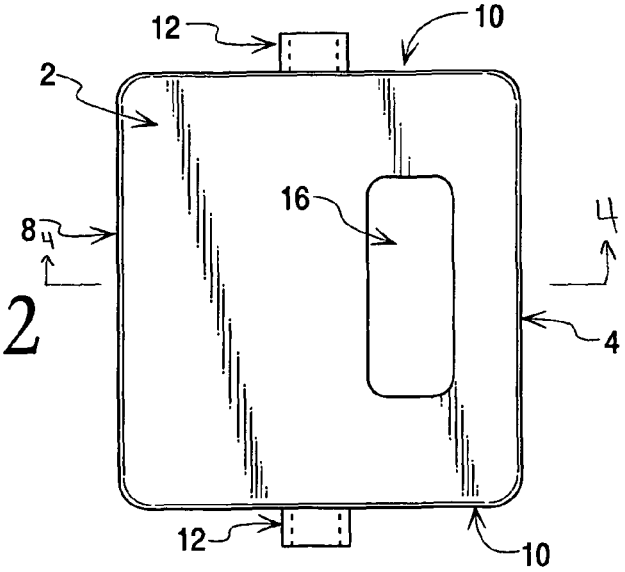
FIG. 2 is a top plan view of the adapter of FIG. 1.
Figure 1:
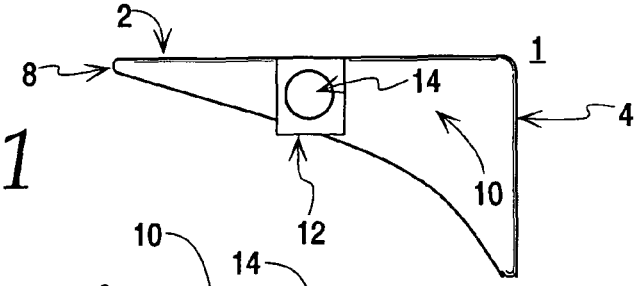
FIG. 1 is a side elevation view of one embodiment of the adapter.
Figure 3:
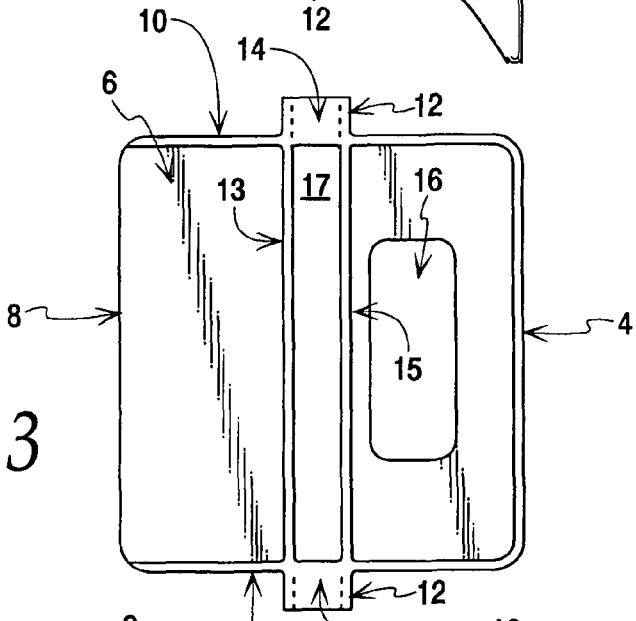
FIG. 3 is a bottom plan view of the adapter.
Figure 4:
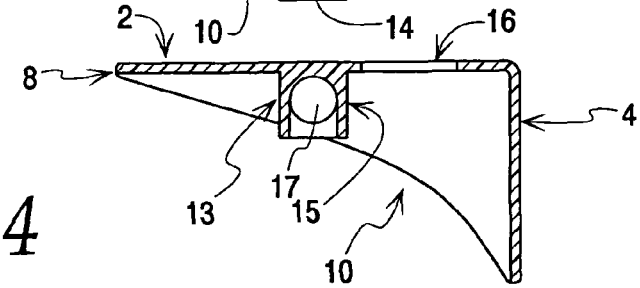
FIG. 4 is a section taken along line 4-4 of FIG. 2.

FIGS. 1-4 illustrate the adapter of the present invention generally at 1. The adapter has box structure formed by a top plate 2, a back wall 4, and two opposing side walls 10. The top plate 2 has a free edge 8. Opposite the free edge is a right angle corner where the top plate 2 connects to the back wall 4. The side walls 10 are generally triangular gussets that join both the top plate 2 and the back wall 4. As seen in FIGS. 1 and 4 the hypotenuse of the gussets may have a curved or arched configuration, the curvature of which becomes more pronounced toward the back wall. The top plate and the back and side walls form an open-sided, box structure with surfaces in three mutually perpendicular planes.

Four-sided knobs 12 extend outwardly from the side walls 10. The top edges of the knobs are flush with the upper surface of the top wall. Openings 14 extend fully through the knobs. As explained below, when the adapter 1 is inserted into a carton, the knobs 12 provide a guide and support for a rod or shaft to be inserted into the openings 14 and through the adapter 1. In this embodiment, the knobs 12 are generally square. However, the knobs 12 could have other shapes or they could be placed in different locations with respect to the top plate and back walls.

An aperture through the top plate 2 defines a handhold 16. The handhold 16 is designed to be comfortable to grip and to carry the combination of the adapter 1 and a carton.

The underside 6 of top plate 2 has two depending walls or ribs 13 and 15. Ribs 13 and 15, together with the portion of the top plate 2 between them and the knobs 12, define a shaft-receiving sleeve. A passageway or channel 17 is defined by the ribs 13, 15 and the portion of the top plate 2 between the ribs. Channel 17 aligns with openings 14 in the knobs 12. The passageway 17 extends from one side wall 10 to the other side wall 10. The openings 14 and the channel or passageway 17 allow a bar, dowel, shaft, or rod (not shown) to be passed through the adapter 1 such that the adapter 1 may be hung from a pulling rack on the bar, dowel, shaft, or rod. The openings 14 and the passageway 17 may have different configurations to receive different shapes or sizes of rods or shafts. That is, while the openings 14 are shown with a circular cross section, the cross section could be non-circular to provide an anti-rotation feature. Also, while the channel 17 is shown open to the bottom, the fourth side of the channel may also be enclosed to fully shield a rod or shaft inserted therein.

Figure 5:
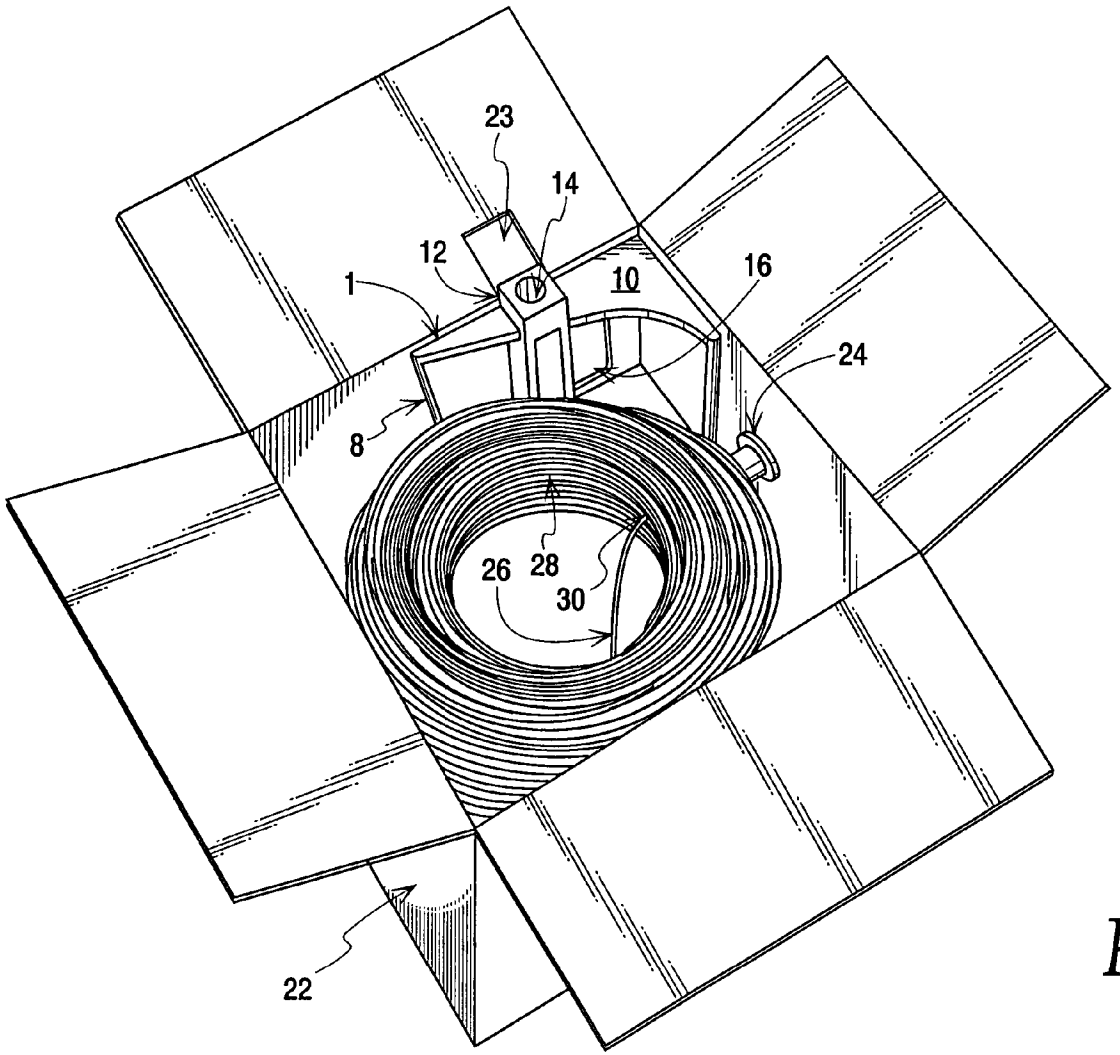
FIG. 5 is a perspective view of a non-reel wire carton with its flaps open on one side to illustrate the adapter of the present invention installed therein.

FIG. 5 illustrates the adapter in preparation for use. The adapter 1 is inserted into a corner of a carton 22 containing a non-reel or "air core" coil of filamentary material 28 such as wire or cable. Typically, these cartons 22 or containers are constructed using cardboard or similar materials. As a result, the configuration of the adapter 1 is designed to reinforce or provide structural support for the carton, such that when the carton is hung utilizing the adapter 1, gravity and pulling loads on the carton 22 are spread out over a large surface area. By spreading out these loads, the adapter 1 reduces the possibility of the carton tearing or otherwise failing. The knobs 12 extend outwardly, through cutouts 23 in the carton 22, and slightly beyond the exterior surfaces of the carton 22. The engagement of the protruding knobs 12 with the cutouts 23 locks the adaptor in place in the carton. The knobs also serve as spacers between adjacent cartons or reels on a pulling rack. It sometimes happens that a non-reel carton is placed on a rack next to a spool or reel. Rotation of the reel can potentially damage the cardboard carton of the non-reel container. The knobs absorb such contact and prevent the cardboard carton from being damaged by adjacent reels.

As shown in FIG. 5, an inner strand 26 of the non-reel coil 28 is paid out from the innermost coil 30 through the body of the coil and out the side of the carton 22 by way of a payout tube 24. The payout tube 24 is mounted in a side wall of the carton. The design and placement of the adapter 1 does not interfere with the paying out of the coil 28.

Figure 6:
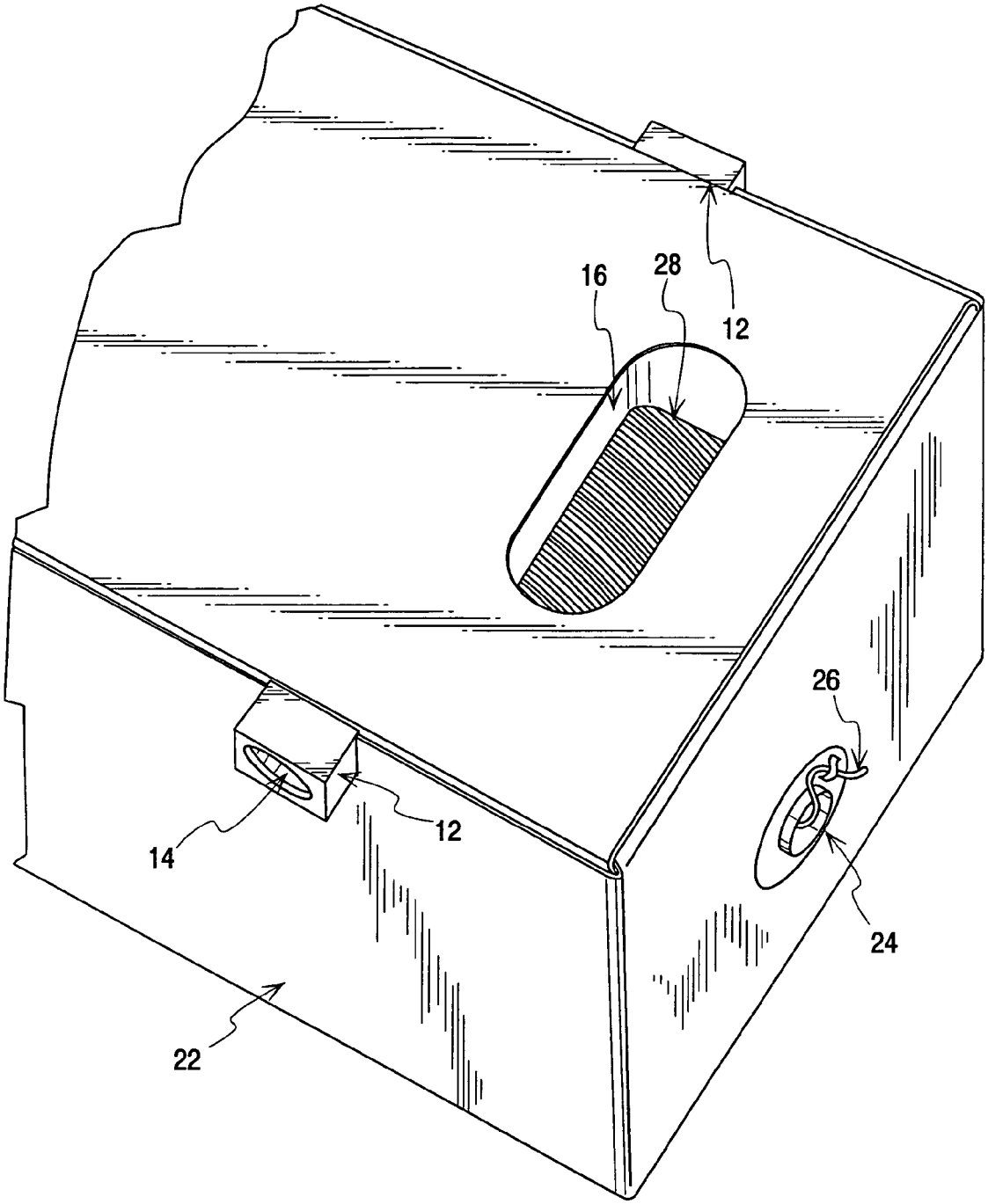
FIG. 6 is a perspective view of a non-reel wire carton that is ready to be hung from a shaft, illustrating how the adapter is situated in a closed carton containing a non-reel coil of filamentary material.

FIG. 6 shows the top of a closed carton 22 in what might be considered a normal, upright position. In this position, the adapter 1 sits in an upper corner above the payout tube 24. The knobs 12 of the adapter 1 extend outside of the closed carton 22. To hang the carton 22 from a pulling rack, a shaft of the pulling rack would be inserted into the opening 14 in one of the knobs 12, through the channel 17 and out the opposite opening 14. The ends of the shaft are then secured in the rack. As can be seen through the handhold 16, the non-reel coil 28 sits in the carton 22 in a vertical position. The strand 26 of filamentary material from the coil 28 is paid out through payout tube 24 in the side of the carton. Note also that the handhold 16 aligns with an opening in the carton 22. This allows the carton to be conveniently grasped at the handhold and carried without risk of tearing or damaging the carton, even if the carton is wet.

The adapter is preferably installed in a corner of the carton, although it could be otherwise. Placement of the adapter in a corner allows the carton to hang on a shaft at an angle so that gravity and pulling loads are spread on to two perpendicular walls. The adapter has a simple, one-piece construction that is quick and easy to install. By converting a non-reel carton for use with a pulling rack, a wire supplier can reduce the amount of inventory formerly needed for different types of packages. The adapter allows a non-reel carton to provide the benefits of a reel while avoiding its disadvantages.

The adapter may have an alternate box structure that allows the adapter to fit inside a carton or container. As shown in FIGS. 7-10, instead of having walls in three planes, it could be that the adapter walls only define two planes.

FIGS. 7-10 illustrate an alternative embodiment of the adapter of the present invention generally at 31. The adapter 31 has a box structure, with walls or surfaces in two perpendicular planes. The box structure is formed by a top plate 32, a stiffening wall 34, a front rib 36 and an interior rib 38. The front rib 36, the interior rib 38 and a portion of the top plate 32 define a passageway or channel 40.

An opening 42 through the top plate 32 defines a handhold. The handhold 42 is designed to be comfortable to grip and to carry the combination of the adapter 31 and a carton. Typically, non-reel cartons containing filamentary material have an opening for a handhold at the top of the carton. The handhold 42 aligns with this opening in the top of the carton. An electrician or other user of these cartons accesses this handhold by pushing into the carton one or more partially perforated flaps. The perforated flaps of the carton will pass through the handhold opening 42 of the top plate 32 and further aid in securing the adapter to the interior of a carton. This also allows the carton to be conveniently grasped at the handhold and carried without risk of tearing or damaging the carton, even if the carton is wet.

Several other smaller openings 44, may be added to the top plate to reduce the amount of material required to manufacture the adapter 31. Similarly, optional grooves 46 along the trailing edge 48, leading edge 49, and the top plate 32 may be added to further reduce the material require to manufacture the adapter 31. The grooves 46 may also further aid in securing the adapter within the carton.

The underside 50 of the top plate 32 has three depending structures, a front rib 36 and interior rib 38 and a stiffening wall 34. Ribs 36 and 38 together with a portion of the underside 50 of the top plate 32 define a shaft-receiving channel or passageway 40. The passageway 40 extends outwardly past the sides of the top plate 32. The channel or passageway 40 allows a bar, dowel, shaft, or rod (not shown) to be passed through the adapter 31 such that the adapter 31 may be hung from a pulling rack on the bar, dowel, shaft, or rod. While the channel 40 is shown open to the bottom, the fourth side of the channel may also be enclosed to fully or partially shield a rod or shaft inserted therein.

Along the trailing edge 48 is a right angle corner where the top plate 32 connects with the stiffening wall 34. The stiffening wall 34 may have numerous configurations and may contain openings 52 of various sizes and shapes. The openings may be added to reduce the amount of material needed to manufacture the adapter 31.

Figures 7, 8, 9, 10:
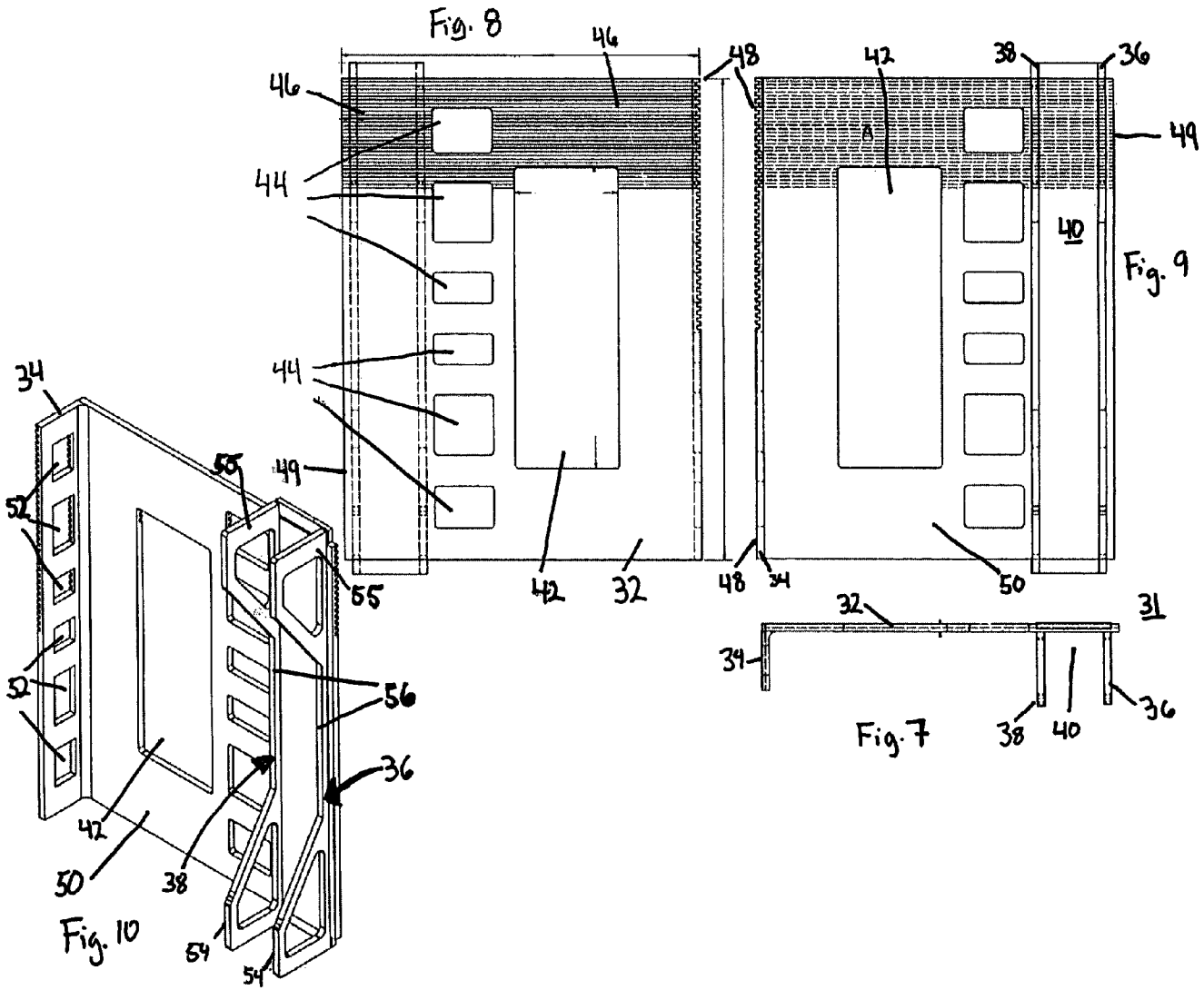
FIG. 7 is a side elevation view of an alternate embodiment of the adapter.
FIG. 8 is a top plan view of the adapter of FIG. 7.
FIG. 9 is a bottom plan view of the alternate embodiment of the adapter.
FIG. 10 is a perspective view of the adapter of FIG. 7.
Figure 11:
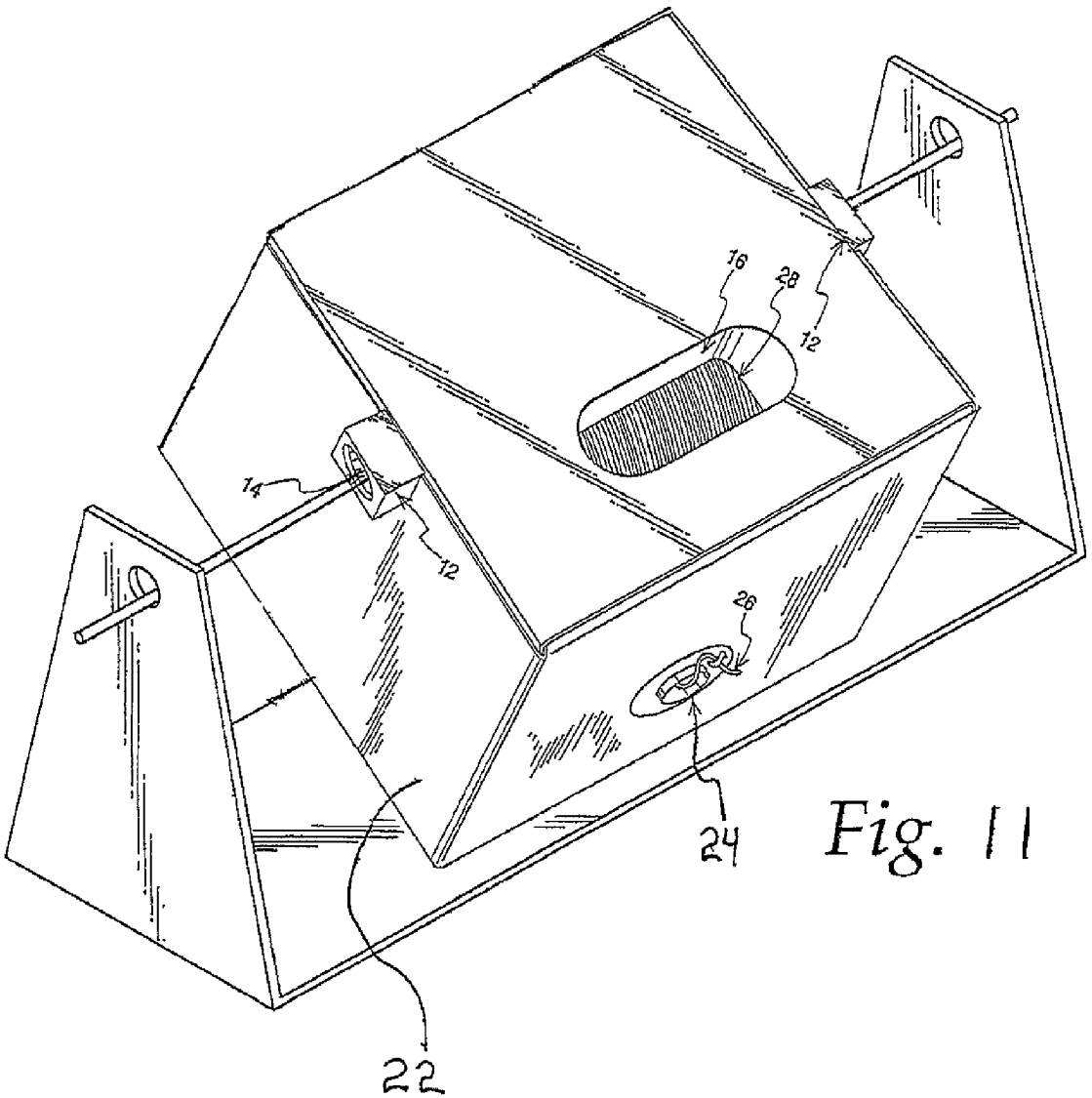
FIG. 11 is a perspective view of a non-reel wire carton hanging from a shaft that is mounted to a rack.

Similarly, the front rib 36 and interior rib 38 may have numerous configurations and shapes. As shown in FIG. 10, the front rib 36 and interior rib 38 may be formed by two opposing trapezoidal extensions 54, 55 located adjacent to either side of the top plate 32. A ridge 56 connects the trapezoidal extensions 54, 55. The trapezoidal extensions may have openings or apertures, for example, to decrease the amount of material used in construction of the adapter or to provide handholds for both the adapter and the carton. It is not necessary for the front rib 36 and interior rib 38 to have the same configuration.

The adapter 31 is installed within carton against the interior top surface of the carton. Placement of the adapter 31 along the top of the carton allows the carton to hang on a shaft at an angle so that gravity and pulling loads are spread along the top surface or wall of the carton. The adapter has a simple, one-piece construction that is quick and easy to install. By converting a non-reel carton for use with a pulling rack, a wire supplier can reduce the amount of inventory formerly needed for different types of packages. The adapter allows a non-reel carton to provide the benefits of a reel while avoiding its disadvantages.

The first embodiment of the adapter 1 and second embodiment of the adapter 31 may have other configurations and structures. For example, the back wall of first embodiment of the adapter 1 may be deleted. In this case, it may be desirable to have the ends of the side walls butt up against an end wall of the carton. Alternately, the two-sided box structure could be located remote from an end wall of the carton. In any case, the box structure must be designed to fit around a non-reel coil of filamentary material (wire, cable, etc.) enclosed within a carton. In another alternate embodiment, the back wall 4 of the first embodiment of the adapter 1 could be extended from that shown so a payout opening could be formed in the wall.

The first embodiment of the adapter 1 and second embodiment of the adapter 31 may also contain additional apertures or openings, for example, to decrease the amount of material used in construction of the adapter or to provide handholds for both the adapter and the carton. Accordingly, while the top plate and side walls are shown as largely continuous surfaces of the first embodiment of the adapter 1, it could be otherwise so long as the top plate prevents concentration of loads between the shaft and the carton. It may also be manufactured from different materials.

We claim:

1. An article for dispensing filamentary material, comprising:

a carton including a top panel having an interior surface and opposite side edges, the carton further including a side panel joined to each of the side edges of the top panel, the top and side panels defining an interior and exterior of the carton, each side panel having a cutout therein with the cutouts at least partially aligned with one another; and an adapter disposed in the interior of the carton, the adapter having a top plate parallel to and in engagement with the interior surface of the carton's top panel, the top plate of the adapter being disposed adjacent the cutouts such that the top plate is engageable with a shaft inserted from the exterior of the carton through the cutouts, the top plate spreading the load of the shaft onto the top panel, wherein the adapter further comprises at least one extension extending from the top plate and engageable with the carton.

2. The article for dispensing filamentary material of claim 1 wherein the extension extends from the top plate beyond the side edges thereof.

3. The article for dispensing filamentary material of claim 1 wherein the extension comprises a knob attached to the top plate and extending through one of the cutouts.

4. The article for dispensing filamentary material of claim 3 wherein the knob extends below the top plate and is engageable with a shaft inserted from the exterior of the carton through the cutouts, the knob transferring the load of the shaft onto the top panel.

5. An article for dispensing filamentary material, comprising:

a carton including a top panel having an interior surface and opposite side edges, the carton further including a side panel joined to each of the side edges of the top panel, the top and side panels defining an interior and exterior of the carton, each side panel having a cutout therein with the cutouts at least partially aligned with one another; and an adapter disposed in the interior of the carton, the adapter having a top plate parallel to and in engagement with the interior surface of the carton's top panel, the top plate of the adapter being disposed adjacent the cutouts such that the top plate is engageable with a shaft inserted from the exterior of the carton through the cutouts, the top plate spreading the load of the shaft onto the top panel and, further comprising an opening in the top panel intermediate its side edges and a handhold in the top plate at least partially aligned with the opening in the top panel.

6. The article for dispensing filamentary material of claim 5 further comprising an opening in the top panel intermediate its side edges and a handhold in the top plate at least partially aligned with the opening in the top panel, the handhold being located between the wall attached to the top plate and the portion of the adapter that is engageable with a shaft.

7. An adapter for a carton comprising:

a top plate engageable with a surface of the carton on the interior thereof, at least a portion of the top plate being engageable with a shaft inserted from the exterior of the carton through the carton, the top plate spreading the load of the shaft onto the surface of the carton; and a handhold in the top plate, wherein the adapter further comprises a wall attached to the top plate and extending out of the plane thereof and wherein the adapter further comprises at least one extension extending from the top plate and engageable with the carton.

8. An adapter for a carton comprising:

a top plate engageable with a surface of the carton on the interior thereof, at least a portion of the top plate being engageable with a shaft inserted from the exterior of the carton through the carton, the top plate spreading the load of the shaft onto the surface of the carton; and a handhold in the top plate, wherein the adapter further comprises at least one extension extending from the top plate and engageable with the carton.

9. An adapter for a carton comprising:

a top plate engageable with a surface of the carton on the interior thereof, at least a portion of the top plate being engageable with a shaft inserted from the exterior of the carton through the carton, the top plate spreading the load of the shaft onto the surface of the carton; and at least one extension extending from the top plate and engageable with the carton, wherein the adapter further comprises a wall attached to the top plate and extending out of the plane thereof, and wherein the extension lies in the same plane as the top plate.

10. The adapter of claim 9 wherein the wherein top plate includes side edges and the extension extends from the top plate beyond the side edges thereof.

* * * * *